US008783857B2

(12) United States Patent
Roof et al.

(10) Patent No.: US 8,783,857 B2
(45) Date of Patent: Jul. 22, 2014

(54) QUARTZ TUBE LEVELING APPARATUS AND SYSTEMS FOR SIMULTANEOUS LEVELING AND PINNING OF RADIATION CURABLE INKS

(75) Inventors: Bryan J. Roof, Newark, NY (US); David J. Gervasi, Pittsford, NY (US); Bin Zhang, Penfield, NY (US); James Padula, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 75 days.

(21) Appl. No.: 13/525,232

(22) Filed: Jun. 15, 2012

(65) Prior Publication Data

US 2012/0255489 A1 Oct. 11, 2012

Related U.S. Application Data

(63) Continuation-in-part of application No. 12/256,670, filed on Oct. 23, 2008, now Pat. No. 8,231,214.

(51) Int. Cl.
*B41J 2/01* (2006.01)

(52) U.S. Cl.
CPC ..... *B41J 2/01* (2013.01)
USPC ..... 347/104

(58) Field of Classification Search
CPC ..... B41J 2/01
USPC ..... 347/102, 104
See application file for complete search history.

(56) References Cited

U.S. PATENT DOCUMENTS

| | | | | |
|---|---|---|---|---|
| 3,874,962 | A | 4/1975 | Gersbeck et al. | |
| 5,267,005 | A | 11/1993 | Yamamoto et al. | |
| 6,494,570 | B1 | 12/2002 | Snyder | |
| 6,923,533 | B2 | 8/2005 | Pan et al. | |
| 7,887,176 | B2 | 2/2011 | Kovacs et al. | |
| 8,177,332 | B2 * | 5/2012 | Thompson et al. | 347/51 |
| 2001/0055047 | A1 * | 12/2001 | Ohsawa et al. | 347/55 |
| 2002/0158963 | A1 | 10/2002 | Dietze | |
| 2003/0103123 | A1 | 6/2003 | Snyder | |
| 2005/0280690 | A1 * | 12/2005 | Preszler | 347/171 |
| 2006/0077246 | A1 | 4/2006 | Kawakami et al. | |
| 2006/0103709 | A1 | 5/2006 | Burdenko et al. | |
| 2006/0176538 | A1 * | 8/2006 | Hirayama et al. | 359/223 |
| 2006/0290760 | A1 | 12/2006 | German et al. | |
| 2007/0120921 | A1 | 5/2007 | Carlini et al. | |

(Continued)

FOREIGN PATENT DOCUMENTS

JP 2005-173441 6/2005

OTHER PUBLICATIONS

Bryan J. Roof, U.S. Appl. No. 12/256,670, filed Oct. 23, 2008.
Bryan J. Roof, U.S. Appl. No. 13/525,239, filed Jun. 15, 2012.

*Primary Examiner* — Charlie Peng
(74) *Attorney, Agent, or Firm* — Ronald E. Prass, Jr.; Prass LLP

(57) ABSTRACT

Systems for leveling UV-curable gel ink include a leveling member having a conformable surface. The leveling member is a quartz tube rotatable about a longitudinal axis, and connected to a mandrel, with conformable VITON O-rings interposing the mandrel and the quartz tube. A UV source is disposed within the quartz tube, and configured to emit light through the quartz tube and the conformable surface onto a surface of a substrate passing through a leveling or pressure nip defined by the quartz tube and a backing member or pressure belt.

19 Claims, 7 Drawing Sheets

(56) References Cited

U.S. PATENT DOCUMENTS

2007/0120930 A1 5/2007 Domoto et al.
2008/0122914 A1 5/2008 Toma et al.
2010/0033545 A1 2/2010 Caiger et al.
2010/0212821 A1 8/2010 Grinberg

* cited by examiner

QUARTZ TUBE LEVELING APPARATUS AND SYSTEMS FOR SIMULTANEOUS LEVELING AND PINNING OF RADIATION CURABLE INKS

RELATED APPLICATIONS

This application is a continuation-in-part of U.S. patent application Ser. No. 12/256,670 entitled "METHOD AND APPARATUS FOR FIXING A RADIATION-CURABLE GEL-INK IMAGE ON A SUBSTRATE," the disclosure of which is incorporated by reference herein in its entirety. This application is related to co-pending U.S. patent application Ser. No. 13/525,239 entitled "BELT LEVELING APPARATUS AND SYSTEMS FOR SIMULTANEOUS LEVELING AND PINNING OF RADIATION CURABLE INKS," the disclosure of which is incorporated by reference herein in its entirety.

FIELD OF DISCLOSURE

The disclosure relates to printing with radiation-curable inks. In particular, the disclosure relates to leveling radiation curable gel ink on a substrate using a quartz leveling member having a conformable surface layer.

BACKGROUND

US Patent Application Publication US 2008/0122914 A1 discloses compositions for an ultraviolet (UV)-curable ink suitable for use in ink-jet printing. Such inks include one or more co-monomers and a gellant. When exposed to radiation of a predetermined frequency, these co-monomers polymerize and thus bind to any number of types of surfaces. In practical applications, such inks have a viscous property at room temperature, but become more liquid when heated for jetting onto a substrate to form images.

US Patent Application Publication US 2007/0120930 A1 discloses a printing apparatus suitable for use with a radiation-curable ink. The apparatus uses a "transfuse" system, wherein ink forming the desired image is first jetted onto an image receptor in the form of a belt, and then transferred from the image receptor onto a print sheet or other substrate. At various locations along the belt path are disposed ultraviolet radiation sources for partially hardening the ink on the belt before transferring to the print sheet.

Although the above-described apparatus uses an image receptor to apply ink to a print sheet, it would be desirable to provide a system where such an ink as above described could be applied directly to a print sheet or other substrate. One challenge to such a system is that, in practical applications, such inks tend to have a "mayonnaise" consistency at room temperature, but when heated incidental to jetting, change to a low viscosity liquid. A typical ink-jet printing process heats the ink until it is liquid and then directly fires ink droplets from a piezoelectric print head onto the substrate. Once the ejected ink hits the substrate, it changes phase from the liquid back to its more viscous consistency, thereby reducing its penetration into porous media. Once this ink is exposed to UV radiation, photoinitiators in the ink are bombarded with UV radiation and the incident flux converts the monomers present in the ink into a cross linked polymer matrix resulting in a very hard and durable mark on the paper.

However, there is a desire to have the ink leveled prior to having it UV cured. The reason for this is so that gloss is more uniform, missing jets can be masked, and certain applications such as packaging require thin layers of relatively constant thickness. Because these inks have a mayonnaise consistency at room temperature, they have very little cohesive strength prior to curing. In addition, the inks are typically designed to have good affinity to many materials. This means that conventional methods for flattening a layer of ink tend to fail, because the ink splits and leaves much of the image behind on the device trying to flatten it, such as a traditional fuser roll as familiar in xerography. Before the ink ejected onto the substrate is cured, it is desirable to level the ink so that gloss is more uniform, missing jets may be masked, and/or certain applications such as packaging may be accommodated by enabling formation of thin ink layers of relatively constant thickness across the surface of the substrate.

SUMMARY

Apparatus and systems for fixing ink on a substrate are disclosed. A leveling member is positioned to contact an ink-bearing side of the substrate at a nip. A first radiation source is positioned to direct radiation to the ink-bearing side of the substrate at the nip, the radiation suitable for curing the ink on the substrate, which may be paper, Mylar, foil, etc.

Radiation curable ink ejected from a print head onto a substrate may be leveled at a pressure nip defined by a leveling member and a backing member, such as a belt entrained by backing rolls. The leveling member may be constructed of a clear fused quartz roll, which may be configured to contact the radiation curable ink at the nip, and while in contact, a light source may be configured to expose the ink to light such that substantial curing occurs while the ink is in the deformed or leveled state.

Apparatus and systems include a quartz leveling member having a conformable surface for leveling ink at such a pressure nip to produce a final printed image having acceptable image quality. In an embodiment, a leveling apparatus useful for printing radiation curable ink on a substrate may include a leveling member, positioned to contact a radiation curable ink-bearing side of the substrate at a nip, the leveling member comprising quartz and a conformable surface. Apparatus may include the leveling member having a conformable surface for contacting the substrate surface, the quartz forming a tube-shape.

Apparatus may include the leveling member being a quartz tube having a light source disposed therein, the light source being contained by the leveling member. In an embodiment, the light source may be a UV light source, or a light-emitting diode array. In an embodiment, one or more light shields may be disposed to block light emitted by the light source. For example, a suitably configured light shield may be disposed to prevent light from being emitted into a media path that passes through the pressure nip when the light source is positioned away from the pressure nip.

In an embodiment, apparatus may include a mandrel or similar suitable support structure, the mandrel being configured to connect the leveling member to a printing system whereby the leveling member may be supported by the mandrel. The mandrel and/or the leveling member may be rotatable, thereby permitting rotation about a longitudinal axis of the tube-shaped leveling member.

In an embodiment, apparatus may include a dampening member, the dampening member interposing the mandrel and the leveling member. The dampening member may be an O-ring that is disposed to interpose and contact the leveling member and the mandrel. The dampening member may comprise a conformable elastomer. For example, the dampening member may comprise VITON. Apparatus may include one or more O-rings configured to interpose the quartz tube and the mandrel where the quartz tube meets the mandrel and is joined thereto.

In an embodiment, apparatus may include a conformable surface coating. The surface coating may be applied to the leveling member. The surface coating may comprise silicone, which may be formed in a thin layer over the quartz. The surface coating may comprise silicone and a reinforcing filler and/or a reinforcing resin. For example, the surface coating may comprise a reinforcing filler including nanocrystalline silica or fumed silica. Apparatus may include the surface coating comprising a reinforcing resin such as a highly-branched siloxane or Q-resin. In an embodiment, apparatus may include the surface coating having a Shore A hardness of 40.

In an embodiment, systems for leveling gel ink on a substrate may include a leveling member, positioned to contact a radiation curable ink-bearing side of the substrate at a pressure nip, the leveling member comprising quartz and a conformable surface. Systems may include a backing member, the backing member defining the pressure nip with the leveling member, the leveling member being a load bearing member during leveling. In an embodiment, systems may include a mandrel, the mandrel being connected to a printing system and configured to support the leveling member whereby the leveling member is rotatable about a longitudinal axis.

In an embodiment, systems may include the leveling member being tube-shaped and having a light source configured to emit light disposed therein, the leveling member being configured so that emitted light may pass through the quartz tube into a first portion of the pressure nip. The leveling member may be configured to contact an ink-bearing side of a substrate at a second portion of the pressure nip, wherein the first portion follows the second portion in a process direction. Systems may include the leveling member having a conformable coating formed on the surface of the leveling member, the coating including silicone having at least one of fumed nanocrystalline silica and a highly branched functional siloxane.

Exemplary embodiments are described herein. It is envisioned, however, that any system that incorporates features of apparatus and systems described herein are encompassed by the scope and spirit of the exemplary embodiments.

DETAILED DESCRIPTION

Figure 1:
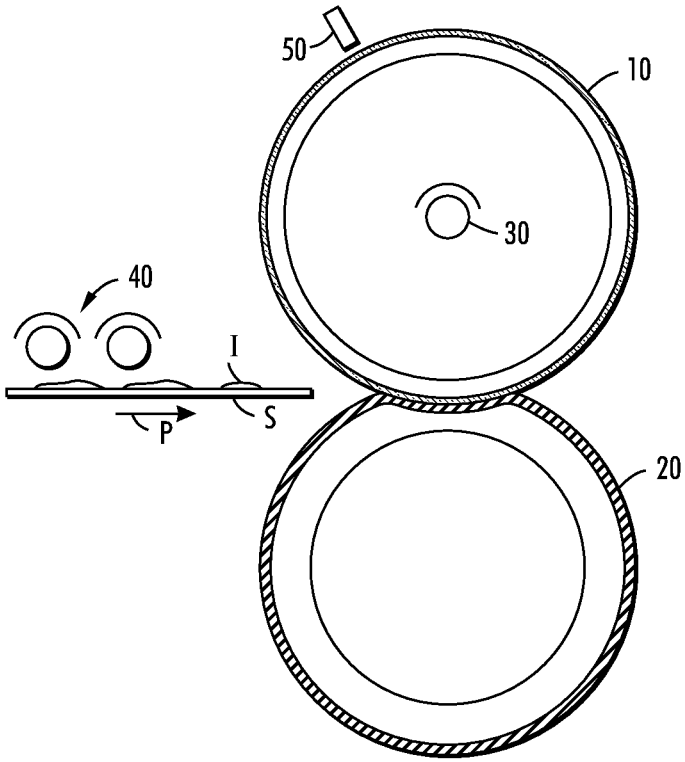
FIG. 1 is a simplified elevational view of a fixing apparatus, as would be found in a larger printing apparatus, according to a first embodiment.

Exemplary embodiments are intended to cover all alternatives, modifications, and equivalents as may be included within the spirit and scope of the apparatus and systems as described herein.

Reference is made to the drawings to accommodate understanding of quartz leveling apparatus and systems for leveling radiation curable ink for printing. In the drawings, like reference numerals are used throughout to designate similar or identical elements. The drawings depict various embodiments related to embodiments of illustrative apparatus and systems for leveling radiation curable ink on a substrate using a quartz leveling member.

FIG. 1 is a simplified elevational view of a fixing apparatus including a leveling member, as would be found in a larger printing apparatus, according to a first embodiment. A sheet or substrate (of any suitable material) S bearing an unfixed ink image I approaches, along a process direction P, a fixing apparatus including a rotatable member, here in the form of an ink-side leveling roller 10, and a backing member here in the form of a backing roller 20. In a practical embodiment, the ink image I comprises at this time an uncured, viscous liquid that has not significantly penetrated into the substrate S. At the nip formed between rollers 10 and 20, the unfixed ink I is mechanically "leveled" by the nip pressure, which effectively causes the various layers of multi-colored inks to assume a consistent total height relative to the surface I of substrate S.

Simultaneous with the mechanical pressure applied at the nip, radiant energy is applied to the ink I, the radiant energy including suitable wavelengths, typically UV, for chemical curing of the ink I on substrate S as any small area of substrate S passes through the nip. For this purpose there is disposed within leveling roller 10 a radiation source 30, which may include for this embodiment one or more UV lamps or a UV-emitting LED array, directing radiation to the ink I in the nip as the substrate S moves therethrough. The power of source 30 or multiple sources is such that the ink I is fully cured by the time it leaves the nip for a given process speed.

In such an embodiment, the walls of leveling roller 10 are effectively transmissive of the curing radiation, so the radiation can efficiently reach the ink I in the nip. According to possible embodiments, leveling roller 10 is comprised of a quartz core with a shrink fit release layer surface. The outer layer of leveling roller 10 is a low surface energy material that also passes UV radiation such as clear PTFE, but other alternatives, such as fluorocarbons, are available. The backing roller 20 is typically formed of silicone over metal.

Also shown in FIG. 1 are IR lamps 40, or equivalents, for pre-heating a substrate S as needed given a particular material set (ink and substrate). A temperature sensor 50 of known type can measure the surface temperature of leveling roller 10 just upstream of the nip, the recorded temperature being useful for a control system.

The curing of ink I is simultaneous with the mechanical pressure formed at the nip so that sufficient cross linking of monomer chains in the ink is initiated while still under a leveling condition such that polymerization is substantially complete by the time the image I leaves the nip formed by rollers 10 and 20. The process of polymerization results in a solid durable material that experiences some shrinkage. The shrinkage and hardness combined with the low surface energy layer on roller 10 lead to a condition whereby the image tends to self strip from the roller 10.

Figure 2:
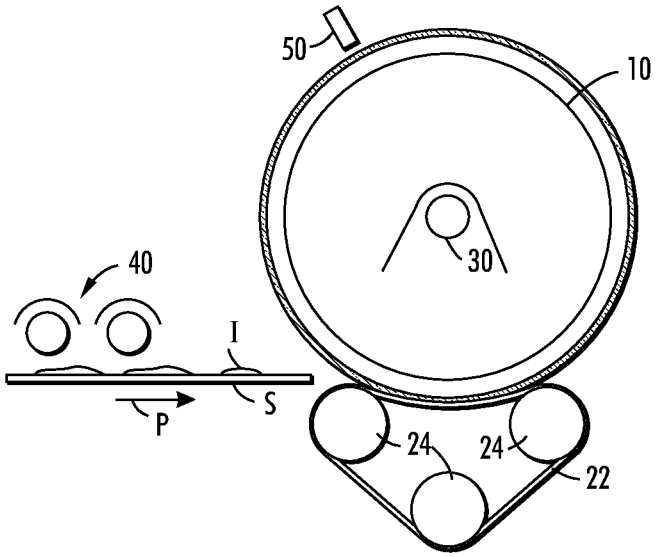
FIG. 2 is a simplified elevational view of a fixing apparatus according to a second embodiment.

FIG. 2 is a simplified elevational view of a fixing apparatus, as would be found in a larger printing apparatus, according to a second embodiment. Like reference numbers from FIG. 1 indicate analogous elements in FIG. 2. The FIG. 2 embodiment differs from FIG. 1 in that, in lieu of the backing roller, there is provided a rotatable backing belt 22, which forms a nip along a significant wrap angle around the leveling roller 10. The belt 22 can be entrained around any number of inner rollers 24 to provide a necessary nip pressure against leveling roller 10. The backing belt 22 provides a significantly longer dwell time for ink under mechanical pressure to be cured by radiation source 30. One basic composition of backing belt 22 includes polyimide with a silicone overcoat.

Figure 3:
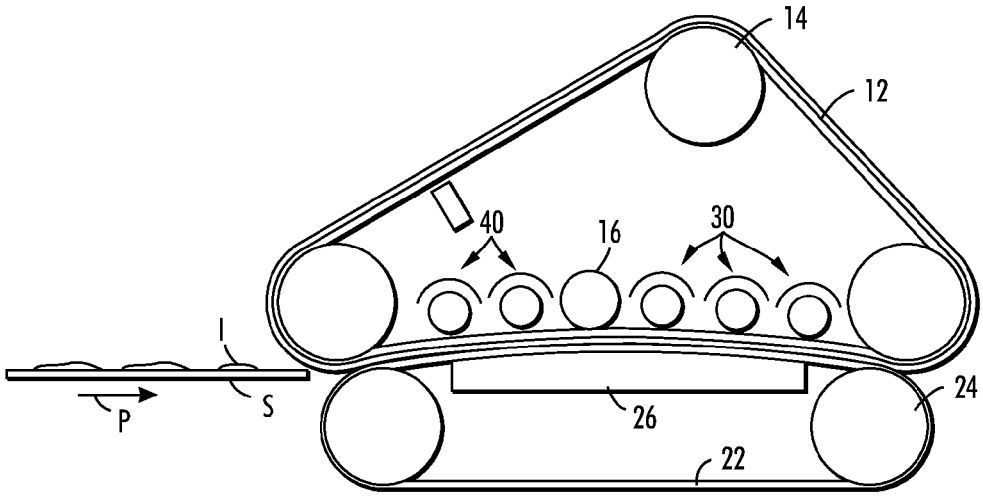
FIG. 3 is a simplified elevational view of a fixing apparatus according to a third embodiment.

FIG. 3 is a simplified elevational view of a fixing apparatus, as would be found in a larger printing apparatus, according to a third embodiment. Like reference numbers from FIG. 1 or FIG. 2 indicate analogous elements in FIG. 3. In this embodiment, in lieu of a leveling roller, there is provided a leveling belt 12, entrained on any number of inner rollers 14, forming a nip against backing belt 22. An adjustable pressure roller 16 disposed within leveling belt 22 can urge a portion of the belt, along a point in the nip, against backing belt 22, which can be supported with a pressure pad 26, as shown.

The leveling belt 12 includes multiple layers. An inner layer provides a durable surface that serves as support and a drive surface. One suitable material is a clear (to UV) polyimide. The outer layer of leveling belt 12 includes a low surface energy material that also passes UV radiation; one suitable material is clear PTFE, but other alternatives, such as fluorocarbons, are possible. The adhesive between the layers must also be effectively transmissive of UV.

The nip pressure is held constant through the length of the nip by the slightly curved pressure pad 26 inside the backing belt 22 that applies force normal to the backing belt 22, thereby pushing it into the leveling belt 12, and causing substrates S passing therethrough to be bent outward with respect to the uncured ink I thereon. The outward bending aids in the self-stripping of the ink.

Further as can be seen in FIG. 3, IR lamps 40 as described above are disposed within leveling belt 12 at an early part of the nip along the process direction P. These lamps, or equivalents, are used to bring the ink I and substrate S to a predetermined temperature prior to curing, as needed. Following the adjustable pressure roller 16, the UV sources 30 cure the ink I onto substrate S.

Although the two radiation sources in the illustrated embodiment provide first IR for heating and then UV for curing, different applications may require different arrangements of radiation sources. For example, if a plurality of inks is placed on substrate S, such as for different primary colors or other attributes such as magnetic properties, it may be desired to cure one ink (having one particular curing wavelength) before the other (having another particular curing wavelength). The radiation sources can be arranged to effect this ordered curing. Alternatively, multiple radiation sources may differ in other aspects, such as amplitude, to obtain desired print properties, such as gloss, given a particular material set.

A leveling member or roll suitable for simultaneous leveling and pinning of ink to a substrate may be formed in a tube-shaped material comprising fused silica quartz. A clear photovoltaic encapsulate quality silicone overcoat may be formed on the quartz tube. The quartz tube may or may be not treated for inter-layer adhesion, and may or may not include a clear adhesive primer for bonding the silicone to the quartz tube.

In radiation curable ink printing, radiation curable ink such as UV gel ink may be applied to a substrate such as paper, mylar, or foil by way of a print head in heated liquid form. After the ink contacts the paper, the ink cools, and as the ink cools, the ink gels and tends to stick to surfaces at a leveling or pressure nip may be formed between a leveling member having a hard surface and a backing belt, for example.

In an embodiment of apparatus and systems, however, the leveling member may be a leveling roll comprising multiple layers, including a conformable outer surface layer. An inner layer of the leveling roll may include silica quartz similar to that which is used for halogen-type light bulbs. For example, GE 214 fused quartz tubing is readily available and is currently used in furnace systems for silicon wafer production. In leveling apparatus and systems, the quartz roll serves as a load bearing member, and is positioned to contact the pressure belt or backing member for defining the leveling or pressure nip. Quartz material has been found to have good strength, optical clarity, and to be resistant to photodegradation. The outer conformable layer may comprise silicone, and may be applied to the quartz roll as a thin film coating by now known or later developed methods. A film or outer layer coating thickness may be adjusted as desired for particular ink formulations or applications.

A light source may be disposed in leveling apparatus and systems whereby light may be emitted onto ink at a leveling nip while ink on the substrate is subject to mechanical pressure and is leveled, or in a leveled or compressed state. For example, the light source may be disposed within the leveling member, which may be a quartz tube-shaped roll. Alternatively, the light source may be disposed outside of the leveling roll, which may interpose the light source and the leveling nip. The leveling roll is transmissive, and light emitted by the light source may pass through the leveling roll and onto ink at the leveling nip as a substrate carrying radiation curable gel ink passes therethrough. Accordingly, the ink may be cured while the ink is in a leveled state in the dwell region of the leveling nip. A conformable surface of the leveling roll allows for printing of uniform ink lines having acceptable, e.g., uniform gloss and no offset of the ink onto a surface of the leveling roll.

Further, one or more leveling apparatus may be implemented in systems useful for printing with radiation curable ink. For example, systems may be configured to include a plurality of leveling apparatus having a leveling roll including a hard quartz layer and a conformable silicone-comprising outer layer. The leveling apparatus may be arranged serially along a media path. A light source may be disposed within each quartz leveling roll, and may be configured to emit light onto a leveling nip defined by the roll and a backing member such as a backing belt system. Each light source of each serially arranged leveling apparatus may be configured to emit light at different respective wavelengths whereby different components of ink deposited on a substrate such as paper may be cured at respective leveling nips of the plurality of leveling apparatus.

Figure 4:
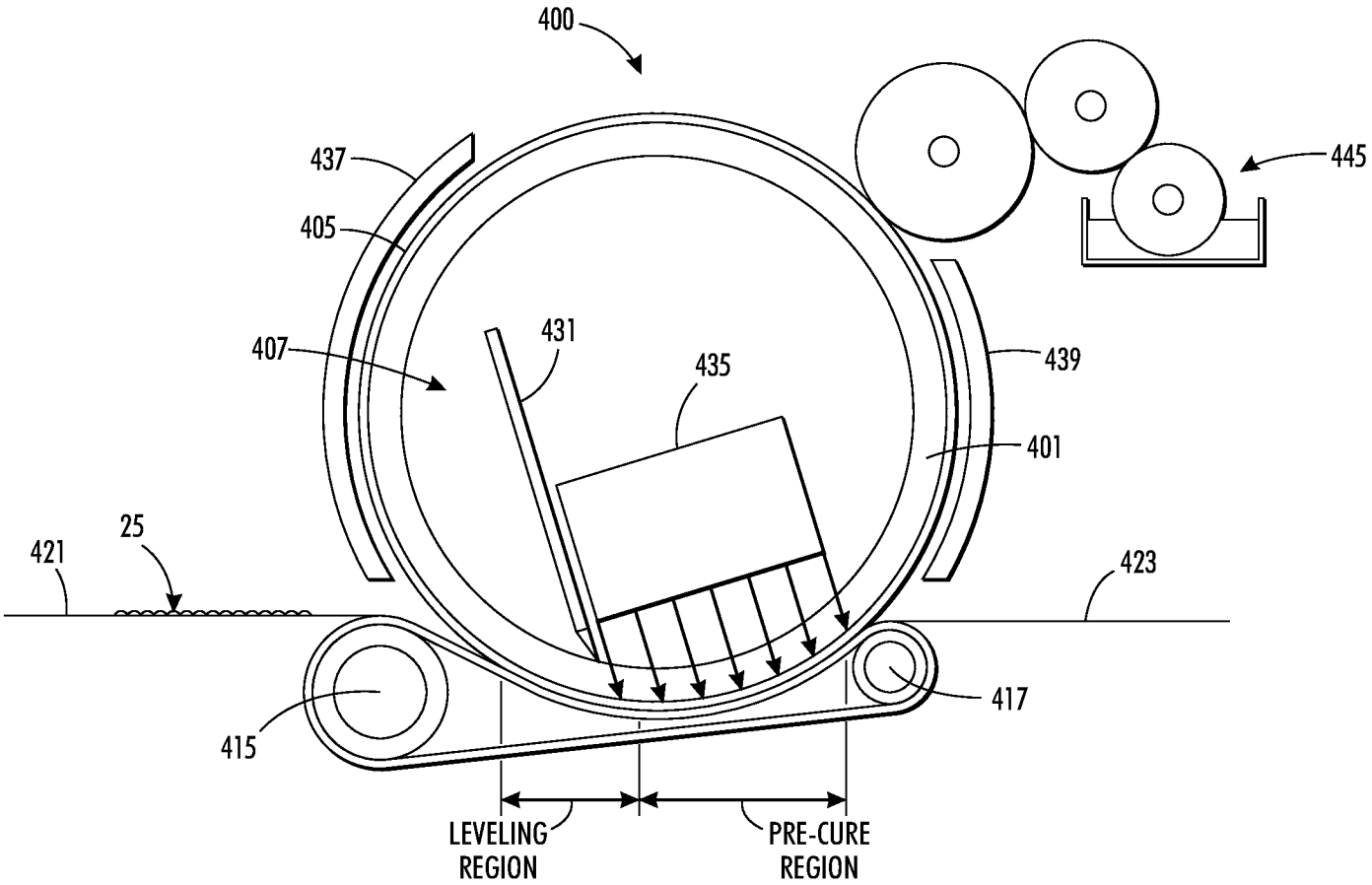
FIG. 4 shows a diagrammatical side view of a fixing apparatus, a quartz leveling member apparatus and system in accordance with an embodiment.

FIG. 4 shows quartz roll leveling member and system in accordance with an embodiment. In particular, FIG. 4 shows a diagrammatical side view of a quartz roll leveling member and system 400. The radiation curable ink leveling system 400 may include a leveling member 401. The leveling member 401 may comprise a quartz tube. The quartz tube 401 may be constructed to define a high-airflow hollow interior 407. Tube may be a fused quartz tube having suitable transmissive qualities, for example, enabling transmission of 395 nanometer wave length light from an LED array.

The leveling roll 401 comprising of the quartz tube may have a conformable coating 405 formed thereon. The conformable coating 405 may be a UV clear elastomeric coating for conformance. The UV clear conformable coating may include silicone. UV conformable coating may also include reinforcing filler and/or reinforcing resin. Reinforcing filler may comprise a fumed silica, or nanocrystalline silica that is suitably transmissive to light. The UV clear elastomeric coating 405 may include a reinforcing resin. For example, the reinforcing resin may include a highly-branched and highly-crosslinked siloxane that is suitably transmissive of light.

Figure 5:
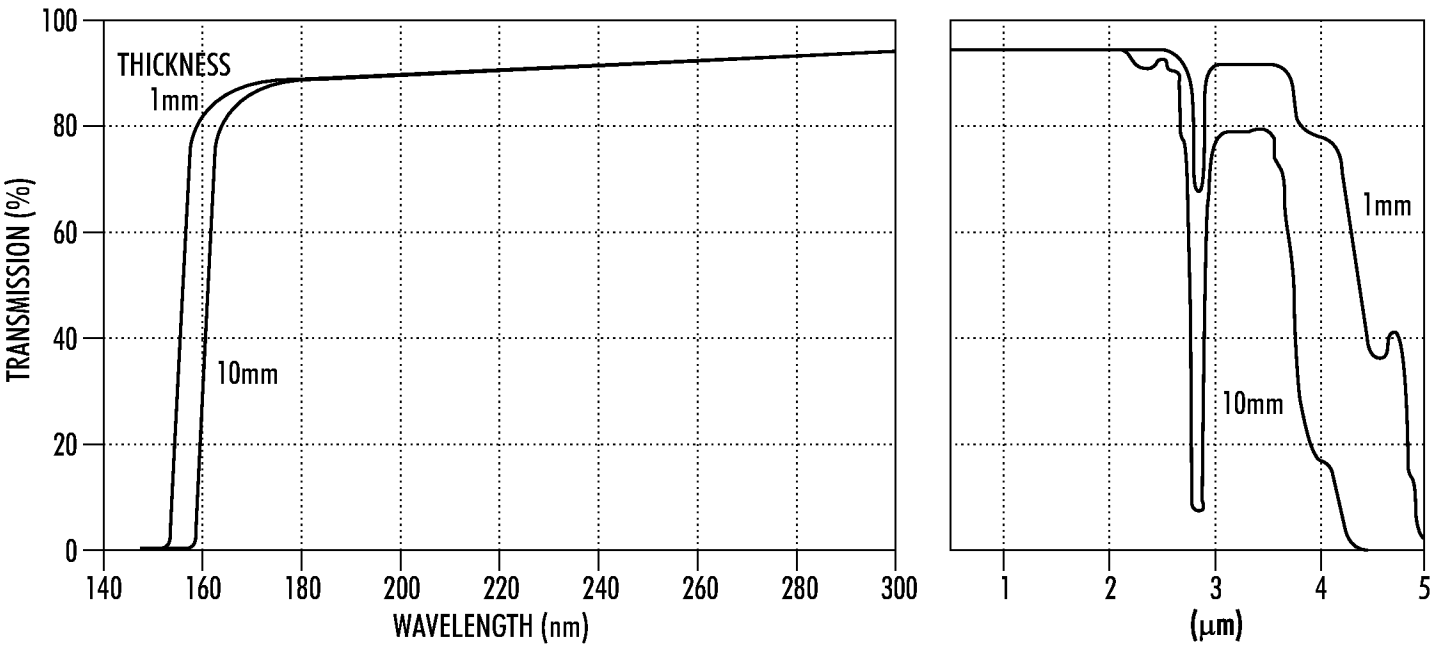
FIG. 5 shows a graph depicting quartz transmission over time.

Quartz is suitable for use as a leveling roll 401 at least because quartz has an acceptable light transmission over a long period of time. This may be seen in the graph shown in FIG. 5, for example. As such, quartz may be implemented as a leveling roll material suitable for enabling contact-pressure leveling of ink at a leveling nip, and curing of the ink in its compressed state by way of light energy. As such ink lines may be produced with minimal offset to the leveling member. However, it has been found by way of extensive testing that when a surface of a leveling member is conformable, lines of radiation curable ink ejected from a print head onto media may be spread so that the lines are uniform and not jagged. As such, a leveling member 401 having a quartz tube may include an elastomeric, conformable layer adhered to a surface thereof for ensuring uniform printed line width.

Figure 6A:
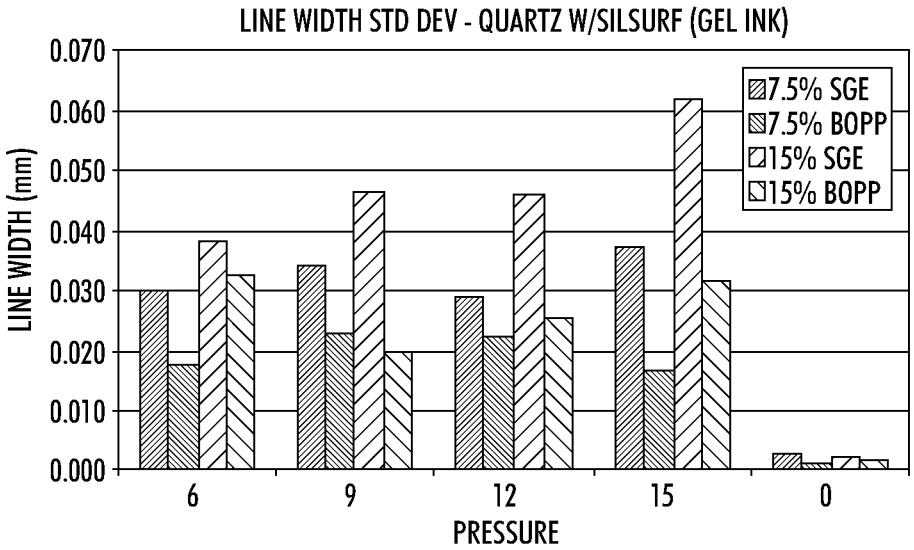
FIG. 6A shows a graph depicting ink line width standard deviation using a quartz leveling member.

A conformable surface enables acceptable line width for enhanced final print image quality having uniform gloss, uniform lines, and no offset onto the leveling member. For example, FIG. 6A shows a graph of line width standard deviation for gel ink deposited on different substrates and leveled using a quartz leveling member surface having a film of fountain solution metered onto a surface thereof. The hard-surface quartz leveling member enables effective curing of gel ink in a leveled state, and enables contact-leveling at a leveling nip with no offset of the ink onto a leveling member. FIG. 6A shows the results of leveling 7.5% and 15% gel ink on semi-gloss elite paper (SGE) and biaxially oriented polypropylene (BOPP) substrates. Pressures are reported in PSI, and line width is reported in millimeters.

Figure 6B:
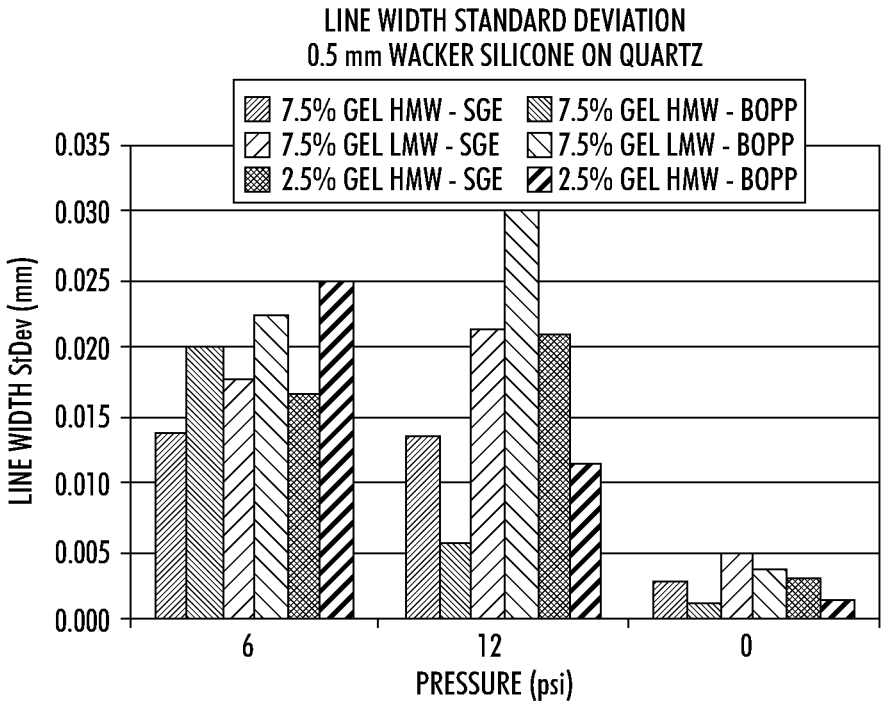
FIG. 6B shows a graph depicting ink line width standard deviation using a silicone-coated quartz leveling member.

FIG. 6B shows the results of leveling 2.5% and 7.5% gel on SGE and BOPP substrates at various pressures. The ink was leveled and cured at the leveling nip using a leveling member having quartz and a conformable surface comprising silicone elastomer. In particular, the results shown in FIG. 6B were produced using a leveling member having a 0.5 mm thick WACKER silicone layer on surface of thereof. In comparison with FIG. 6A, the data shows that a conformable surface improves line quality of ink lines leveled and cured at a contact-leveling nip. The graphs show relative standard deviations in line width that are substantially smaller for prints produced using a leveling member having a conformable surface. Standard deviation of line width is a measure of the variation in line width of a line measured in multiple locations by way of a PIAS-II analyzer. For FIGS. 6A, 6B, and 6C, zero pressure indicates an as-jetted condition. The standard deviation of line width shown in FIG. 6B is generally smaller than that shown in FIG. 6A, suggesting that a leveling member conformable coating or silicone-comprising surface layer enhances image quality by ensuring that lines jetted onto a substrate surface are straight and evenly printed.

Figure 6C:
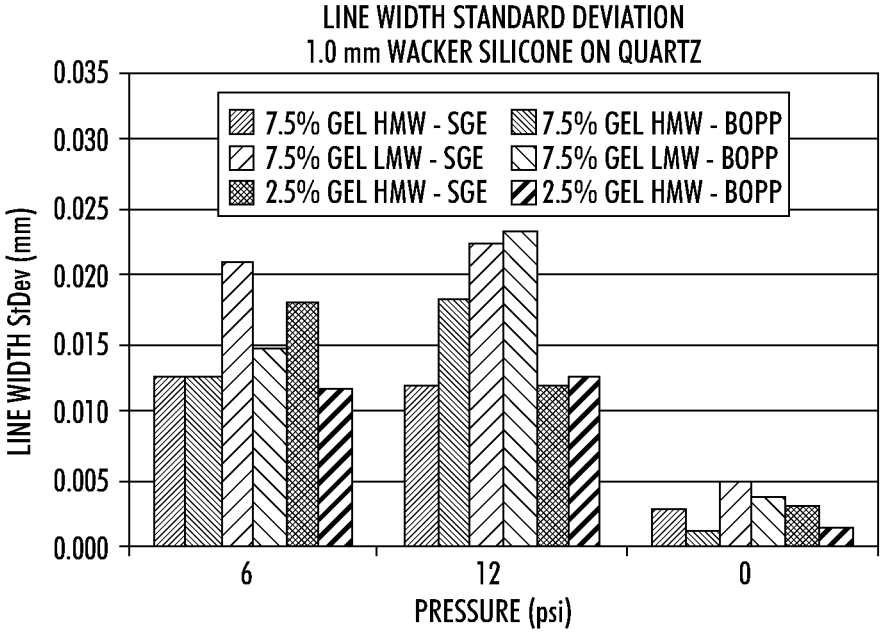
FIG. 6C shows a graph depicting ink line width standard deviation using a silicone-coating quartz leveling member.

FIG. 6C shows the results of leveling 2.5% and 7.5% gel on SGE and BOPP substrates at various pressures. The ink was leveled and cured at the leveling nip using a leveling member having quartz and a conformable surface comprising silicone elastomer. In particular, the results shown in FIG. 6C were produced using a leveling member having a 1.0 mm thick WACKER silicone layer on surface of thereof. In comparison with FIG. 6A, the data shows that a conformable surface improves line quality of ink lines leveled and cured at a contact-leveling nip. The graphs show relative standard deviations in line width that are substantially smaller for prints produced using a leveling member having a conformable surface. The standard deviation of line width shown in FIG. 6C is generally smaller than that shown in FIG. 6A, suggesting that a leveling member conformable coating or silicone-comprising surface layer enhances image quality by ensuring that lines jetted onto a substrate surface are straight and evenly printed. Further, in comparison with the results shows in FIG. 6B, FIG. 6C shows that a conformable surface layer that is thicker than 0.5 mm may result in line width standard deviation that is smaller than line width standard deviations found for gel ink lines printed using a leveling member having a surface layer that is 0.5 mm thick. For example, FIG. 6C shows that improved line uniformity may be achieved with leveling members having a 1 mm thick surface layer than with leveling members having a 0.5 mm surface layer, with respect to, for example, 7.5% gel ink printed on SGE or BOPP.

The conformable coating 405 shown in FIG. 4 may include silicone. It has been found that silicones used as photovoltaic encapsulates work well. For example, room temperature vulcanized silicone such as WACKER RT-601 is suitable. Other silicones that provide the same function may also be suitable, including those silicones provided by Dow Corning such as Sylgard 182 or 184. Other silicones that are clear to UV are also suitable photovoltaic encapsulates or the conformable coating 405, silicone having a hardness of roughly Shore A 40. Particularly preferred conformable formable coatings include reinforcing fillers such as nanocrystalline or fumed silica. Coatings may include reinforcing resin such as a highly branched and/or highly cross-linked siloxane or Q-resin.

It may be desirable to include an adhesion layer for bonding the silicone to the quartz tube. Although an adhesive will likely reduce transmission of light through the leveling member 405, the coating 405 may be formed to be thin, and heat buildup may be compensated for by suitable cooling methods. Adhesives that may be used for bonding silicones to quartz may include corona treatment or a radiation-based exposure such as plasma etching which may have, before which, the effect of creating functional bond sites on a surface of the quartz. Alternatively, a silane adhesive may be used as an intermediate bonding layer, or primer, interposing the quartz and silicone layers.

As shown in FIG. 4, system 400 may include a pressure belt 415 entrained by backing member rollers 417. The pressure belt 415 may be loaded against the leveling member 401 to form a fixed dwell region providing roughly 100 millimeters of contact dwell. The dwell region may include a leveling region and a pre-cure region, following the leveling region in a process direction.

A media path such as a web path 421 may be configured to carry media through the leveling nip defined by the leveling member 401 and the backing member or pressure belt 415. The media may be a substrate such as a paper 423, for example, which may be carried through the media path 421 during a print run. Ink may be heated and deposited by a print head onto a surface of the medium 423. Deposited ink 425 may have a mayonnaise consistency upon approaching the leveling nip including the leveling region and the pre-cure region shown in FIG. 4.

A light shield 431 may be disposed within the quartz tube of the leveling member 401. Preferably, the light shield 431 may be disposed to prevent light from passing through the quartz tube and into the leveling nip at the leveling region thereby preventing premature or undesired curing before adequate leveling. A light source 435 may be disposed within the leveling member 401. The light source may be a UV source, for example, or a LED array. The light source 435 may be configured to emit light into the leveling nip at the pre-cure region shown in FIG. 4. As an ink-bearing side of substrate 423 having mayonnaise consistency ink 425 deposited thereon approaches and then passes through the leveling nip, ink 425 may be leveled by way of pressure applied to the ink against the substrate by way of the leveling member 401 and backing member pressure belt 415. As the leveled ink image passes through a remainder of the leveling nip, and into a pre-cure region of the leveling nip, light may be emitted by light source 435 into the pre-cure region of the leveling nip for curing the leveled ink 425.

Systems may include a first light shield 437 and a second light shield 439 disposed outside of the quartz tube leveling member 401. In an embodiment, the leveling member 401 may be rotatable about a longitudinal axis, and the light shields 437 and 439 may prevent undesirable emission of light from the light source. Systems may further include a dampening system 445. The dampening system 445 may include a fountain solution such as SILSURF or typical fountain solution for applying to a surface of the leveling member 401 for mitigating ink adherence to the leveling member during leveling.

Figure 7A:
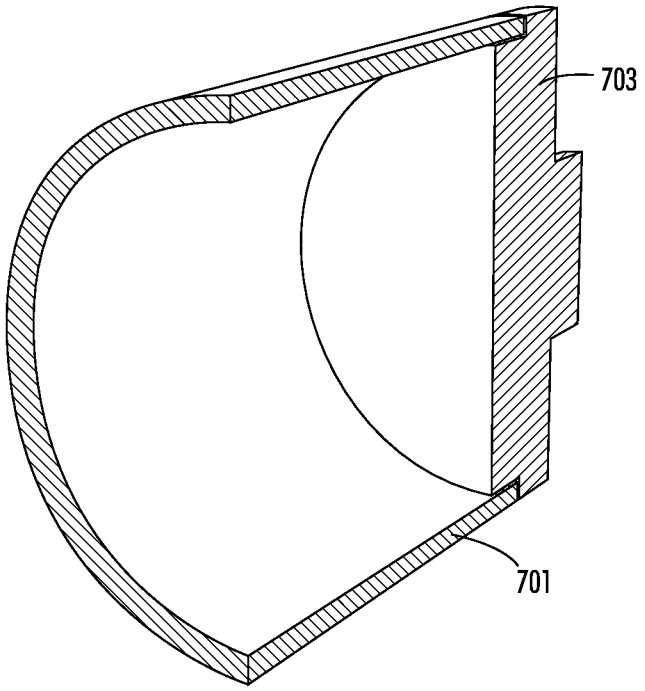
FIG. 7A shows a diagrammatical partial cross-sectional perspective view of a quartz member in accordance with an embodiment.

The quartz tube leveling member 401 may be mounted to a printer system by way of an external mounting to which a mandrel next to the quartz tube. For example, FIG. 4A shows a cross-sectional perspective view of a leveling member 401 comprising a quartz tube connected to a mandrel. The leveling member 401 may be connected to a printer system by way of the mandrel as shown in FIG. 7A, the quartz tube 701 may be connected to the mandrel 703. The quartz tube 701 may be configured so that it is slightly longer than a backing member such as a pressure belt. The pressure belt may be an elastomer coated pressure belt that is loaded against the quartz tube to form a fixed dwell region. An average nip pressure may be about 5 PSI, for example.

Figure 7B:
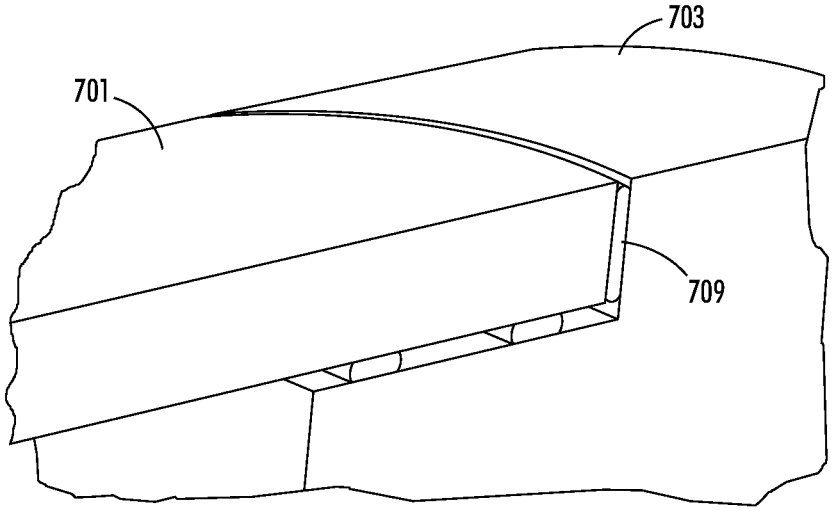
FIG. 7B shows a diagrammatical partial cross-sectional perspective view of a quartz leveling member in accordance with an embodiment.

To enhance an ability of the quartz tube to withstand stress and loading from belt nip pressure, the quartz tube 701 may be connected to the mandrel 703 by way of compressible dampeners. For example, FIG. 7B shows quartz tube 701 connected to a mandrel 703 by way of compressible dampeners 709. FIG. 7B shows the compressible dampeners 509 in a compressed state. The dampeners 709 may comprise O-rings such as VITON O-rings. As shown in FIG. 7B, two O-rings are implemented for radial support and one O-ring is used for axially support. Such an arrangement has been found to easily accommodate a preferred tensile strength for the quartz tube 701 of about 50 MPa, for example.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A leveling apparatus useful for printing radiation curable ink on a substrate, comprising:

a leveling member, positioned to contact a radiation curable ink-bearing side of the substrate at a nip, the leveling member comprising quartz and a conformable surface;

a light source configured to emit light, the leveling member being configured so that emitted light may pass through the quartz and to a first portion of a pressure nip, and the leveling member being configured to contact an ink-bearing side of a substrate at a second portion of the pressure nip, wherein the first portion follows the second portion in a process direction.

2. The apparatus of claim 1, the leveling member comprising the conformable surface for contacting the substrate surface, the quartz forming a tube-shape.

3. The apparatus of claim 1, wherein the leveling member comprising a quartz tube encapsulating the light source.

4. The apparatus of claim 3, comprising the light source being a ultra-violet light source.

5. The apparatus of claim 3, the light source further comprising a light-emitting diode array.

6. The apparatus of claim 3, comprising:

a light shield, the light shield being configured to block light emitted by the light source when the light source is positioned away from the leveling nip.

7. The apparatus of claim 1, comprising:

a mandrel, configured to connect the leveling member to a printing system whereby the leveling member may be supported by the mandrel connected to the printing system.

8. The apparatus of claim 7, comprising:

a dampening member, the dampening member interposing the mandrel and the leveling member.

9. The apparatus of claim 8, comprising the dampening member being an 0-ring, the 0-ring interposing and contacting the leveling member and the mandrel.

10. The apparatus of claim 9, the dampening member comprising a conformable elastomer.

11. The apparatus of claim 1, comprising:

a conformable surface coating, the surface coating being applied to the leveling member.

12. The apparatus of claim 11, wherein the surface coating comprises silicone.

13. The apparatus of claim 12, wherein the surface coating comprises silicone, a reinforcing filler, and a reinforcing resin.

14. The apparatus of claim 13, the reinforcing filler comprising nanocrystalline silica.

15. The apparatus of claim 13, the reinforcing resin comprising a highly-branched siloxane.

16. The apparatus of claim 15, comprising wherein the reinforcing filler comprises fumed silica.

17. A system for leveling gel ink on a substrate, comprising:

a leveling member, positioned to contact a radiation curable ink-bearing side of the substrate at a pressure nip, the leveling member comprising quartz and a conformable surface; and a backing member, the backing member defining the pressure nip with the leveling member, the leveling member being a load bearing member during leveling;

a light source configured to emit light, the leveling member being configured so that emitted light may pass through the quartz tube and to a first portion of the pressure nip, and the leveling member being configured to contact an ink-bearing side of a substrate at a second portion of the pressure nip, wherein the first portion follows the second portion in a process direction.

18. The system of claim 17, comprising:

a mandrel, the mandrel being connected to a printing system and configured to support the leveling member whereby the leveling member is rotatable about a longitudinal axis.

19. The system of claim 18, comprising:

a conformable coating formed on the surface of the leveling member, the coating including silicone having at least one of fumed nanocrystalline silica and a highly branched functional siloxane.

* * * * *